US008647719B2

(12) United States Patent
Shimizu et al.

(10) Patent No.: US 8,647,719 B2
(45) Date of Patent: Feb. 11, 2014

(54) CURTAIN COATING METHOD AND CURTAIN COATING APPARATUS

(75) Inventors: Tomohito Shimizu, Shizuoka (JP); Shuji Hanai, Shizuoka (JP); Hideyuki Kobori, Shizuoka (JP); Nobuyuki Nagasawa, Shizuoka (JP); Tetsuya Hara, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 304 days.

(21) Appl. No.: 13/252,452

(22) Filed: Oct. 4, 2011

(65) Prior Publication Data

US 2012/0082796 A1 Apr. 5, 2012

(30) Foreign Application Priority Data

Oct. 5, 2010 (JP) ..... 2010-225828

(51) Int. Cl.
*B05D 1/30* (2006.01)

(52) U.S. Cl.
USPC ..... 427/420; 118/325

(58) Field of Classification Search
USPC ..... 427/420; 118/300, 325, DIG. 4
See application file for complete search history.

(56) References Cited

U.S. PATENT DOCUMENTS

| | | | | |
|---|---|---|---|---|
| 4,510,882 | A | 4/1985 | Prato | |
| 4,830,887 | A | 5/1989 | Reiter | |
| 5,206,057 | A | 4/1993 | Finnicum et al. | |
| 7,870,833 | B2 | 1/2011 | Kobori et al. | |
| 7,943,200 | B2 | 5/2011 | Shimizu et al. | |
| 2008/0069965 | A1 * | 3/2008 | Kobori et al. | 427/420 |
| 2008/0206496 | A1 | 8/2008 | Kobori et al. | |
| 2010/0021645 | A1 | 1/2010 | Kobori et al. | |
| 2010/0239766 | A1 | 9/2010 | Shimizu et al. | |

FOREIGN PATENT DOCUMENTS

| | | |
|---|---|---|
| JP | 4-22631 | 4/1992 |
| JP | 6-51158 | 7/1994 |
| JP | 2000-225366 | 8/2000 |
| JP | 2001-46939 | 2/2001 |
| JP | 2001-104856 | 4/2001 |
| JP | 2003-71373 | 3/2003 |
| JP | 2006-55703 | 3/2006 |
| JP | 2007-75771 | 3/2007 |
| WO | WO2006/079678 A1 | 8/2006 |

OTHER PUBLICATIONS

Feb. 8, 2012 European search report in connection with counterpart European patent application No. 11 18 3917.

* cited by examiner

*Primary Examiner* — Alexander Weddle
(74) *Attorney, Agent, or Firm* — Cooper & Dunham LLP

(57) ABSTRACT

A curtain coating method including: ejecting at least one layer of a coating liquid from a slit, and making the ejected coating liquid fall freely from a curtain nozzle lip by using a curtain edge guide which guides the coating liquid in the form of a curtain liquid film, so as to apply the coating liquid onto a continuously running web, wherein the coating liquid is applied by moving the curtain edge guide toward the depth direction when the curtain liquid film is seen from the front.

14 Claims, 3 Drawing Sheets

CURTAIN COATING METHOD AND CURTAIN COATING APPARATUS

BACKGROUND OF THE INVENTION

1. Field of the Invention

The present invention relates to a curtain coating method and a curtain coating apparatus, specifically a curtain coating method and a curtain coating apparatus in which at least one layer of a coating liquid is ejected from a slit, and the ejected coating liquid is made to fall freely from a curtain nozzle lip by using a curtain edge guide, which guides the coating liquid in the form of a curtain liquid film, and bringing the curtain liquid film into contact with a continuously running web so as to form a coating film on the web.

2. Description of the Related Art

Conventionally, a curtain coating method has been proposed as a coating method for use in the production of photosensitive materials such as photographic films. The curtain coating method is a method in which a coating liquid formed of various liquid compositions such as a photographic emulsion (hereinafter, referred to as a coating liquid) is fallen freely to form a curtain liquid film, and then the coating liquid film falling freely is brought into contact with a continuously running web, so as to form a coating film on the web.

Various methods are proposed as the curtain coating method of continuously applying a coating liquid onto a running web. For example, various coating methods, such as blade coating, roll coating, wire bar coating, die coating, etc. have been known.

For example, as shown in FIG. 1A, there is a method which includes ejecting a coating liquid from a nozzle slit of a curtain coating head 90, making the ejected coating liquid 92 fall freely by using a curtain edge guide 91, which guides the coating liquid 92 in the form of a curtain liquid film, so as to form a curtain liquid film, and bringing the curtain liquid film into contact with a continuously running web 94 so as to form a coating film on the web 94, and as shown in FIG. 1B, there is a method which includes ejecting a coating liquid 92 from a slit, moving the ejected coating liquid 92 on a slide surface 97, making the coating liquid 92 fall freely from a curtain nozzle lip 99 by using a curtain edge guide 91, which guides the coating liquid in the form of a curtain liquid film, so as to form a curtain liquid film, and bringing the curtain liquid film into contact with a continuously running web 94 so as to form a coating film on the web 94. The reference sign 93 denotes a suction device, 95 denotes a back-up roll, 96 denotes a slide curtain coating head, 98 denotes a slide edge guide. Also, as for multilayer coating, there is a method which includes ejecting coating liquids with various functions from respective nozzle slits, depositing the ejected coating liquids on a slide surface, so as to form a coating film.

In a slide hopper type curtain coating method as shown in FIG. 1B, it has been known that a so-called teapot phenomenon occurs. The teapot phenomenon is a phenomenon in which a coating liquid flows down on a slide surface and is separated from the curtain nozzle lip 99 located in the lower edge of the slide surface, and upon formation of a curtain film, the curtain film does not fall vertically from a lip edge, but the curtain film was shifted toward the back of the lip. It is considered that the teapot phenomenon prominently occurs when the viscosity of a coating liquid decreases or the amount thereof applied increases, in other words when the Reynolds number is relatively large.

When the teapot phenomenon occurs, a curtain film cannot be guided to the curtain edge guide, and the curtain film cannot be formed. Even when a curtain film is formed by maintaining the curtain film by means of a curtain edge guide, the curtain film does not fall vertically on the surface of the curtain edge guide, and the curtain film is deformed, causing uneven coating.

In order to suppress such teapot phenomenon, for example, in Japanese Patent Application Laid-Open (JP-A) No. 2001-46939 a coating method using a flat glass plate as the curtain edge guide is disclosed. In JP-A No. 2006-55703 there is a description of a curtain coating apparatus in which a flat plate-type edge guide is angled toward the moving direction of the substrate.

JP-A No. 2003-71373 discloses a curtain coating method in which the liquid flow velocity on the slide surface, and the surface tension of the coating liquid are adjusted under predetermined conditions. Japanese Patent Application Publication (JP-B) Nos. 06-51158 and 04-22631 disclose the coating method in which the lip of the curtain nozzle is formed into a predetermined shape.

According to the method described in JP-A No. 2001-46939, by increasing the length of the depth direction of the surface of the curtain edge guide, problems caused by the teapot phenomenon can be solved, specifically, the problem that the curtain film cannot be guided to the curtain edge guide can be solved. However, since the surface of the curtain edge guide is flat, it is difficult to make the curtain film vertically fall down on the guide surface, and deformation easily occurs.

In the device described in JP-A No. 2006-55703, the curtain edge guide is a flat plate similar to that descried in JP-A No. 2001-46939, and deformation on the guide surface is hard to correct. Additionally, due to the angled edge guide, the curtain edge guide needs to be arranged to overhang the base material. Therefore, during coating operation, contaminants are brought to a coating part by means of the base material, and then accumulated between the curtain edge guide and the base material, and such problems occur that the base material is cut, etc.

According to the methods described in JP-A No. 2003-71373 and JP-B Nos. 06-51158 and 04-22631, the occurrence of the teapot phenomenon can be prevented to some extend. However, it can be prevented only under the limited conditions, and these methods cannot respond to the various flow rates and the physical properties of the coating liquid.

Since there is only a narrow and limited space for providing the moving unit in the curtain coating apparatus, it is difficult to provide a complex adjustment mechanism according to various coating conditions. It may be because of this reason, at present, the movement of the curtain edge guide toward the depth direction when the curtain film is seen from the front has not been implemented so far.

SUMMARY OF THE INVENTION

An object of the present invention is to provide a curtain coating method and a curtain coating apparatus, in which a curtain edge guide can be moved toward the depth direction when the curtain film is seen from the front, so as to prevent a coating liquid from nonformation or deformation of a curtain film on the curtain edge guide, due to the teapot phenomenon.

Means for solving the problems are as follows.

<1>A curtain coating method including: ejecting at least one layer of a coating liquid from a slit; and making the ejected coating liquid fall freely from a curtain nozzle lip by using a curtain edge guide which guides the coating liquid in the form of a curtain liquid film, so as to apply the coating liquid onto a continuously running web, wherein the coating liquid is applied by moving the curtain edge guide toward the depth direction when the curtain liquid film is seen from the front.

<2> The curtain coating method according to <1>, wherein a distance of moving the curtain edge guide toward the depth direction when the curtain film is seen from the front is 3 mm or more.

<3> The curtain coating method according to any one of <1> and <2>, wherein the curtain edge guide is provided with a pipe-shaped porous material whose end face located close to a web is sealed, and the coating liquid is applied while an auxiliary liquid oozes out from an inside of the pipe-shaped porous material.

<4> The curtain coating method according to <3>, wherein a distance between an upper end of the pipe-shaped porous material in a height direction and the curtain nozzle lip is 1 mm to 7 mm.

<5> The curtain coating method according to any one of <3> and <4>, wherein the pipe-shaped porous material has a diameter of 5 mm to 10 mm.

<6> The curtain coating method according to any one of <1> to <5>, wherein the curtain edge guide is moved by a moving unit, and as the moving unit a moving stage is used.

<7> The curtain coating method according to <6>, wherein the moving unit is driven by a driving unit, and as the driving unit a motor is used.

<8> A curtain coating apparatus including: a slit from which at least one layer of a coating liquid is ejected; a slide surface on which the ejected coating liquid is introduced; a curtain nozzle lip provided on the slide surface; a curtain edge guide configured to guide the introduced coating liquid in the form of a curtain liquid film and make the coating liquid fall freely from the curtain nozzle lip, so as to apply the coating liquid onto a continuously running web, and a moving unit configured to move the curtain edge guide toward the depth direction when the curtain film is seen from the front.

<9> The curtain coating apparatus according to <8>, wherein a distance of moving the curtain edge guide toward the depth direction when the curtain film is seen from the front is 3 mm or more.

<10> The curtain coating apparatus according to any one of <8> and <9>, wherein the curtain edge guide is provided with a pipe-shaped porous material whose end face located close to a web is sealed, and an auxiliary liquid oozes out from an inside of the pipe-shaped porous material.

<11> The curtain coating apparatus according to <10>, wherein a distance between an upper end of the pipe-shaped porous material in a height direction and the curtain nozzle lip is 1 mm to 7 mm.

<12> The curtain coating apparatus according to any one of <10> and <11>, wherein the pipe-shaped porous material has a diameter of 5 mm to 10 mm.

<13> The curtain coating apparatus according to any one of <8> to <12>, wherein the moving unit is a moving stage.

<14> The curtain coating apparatus according to <13>, further includes a driving unit configured to drive the moving unit, wherein the diving unit is a motor.

According to the present invention, it is possible to prevent troubles caused by the teapot phenomenon, specifically, non-formation of a curtain film due to separation of the curtain film from the curtain edge guide, and deformation of a curtain film on the curtain edge guide.

Figure 1A:
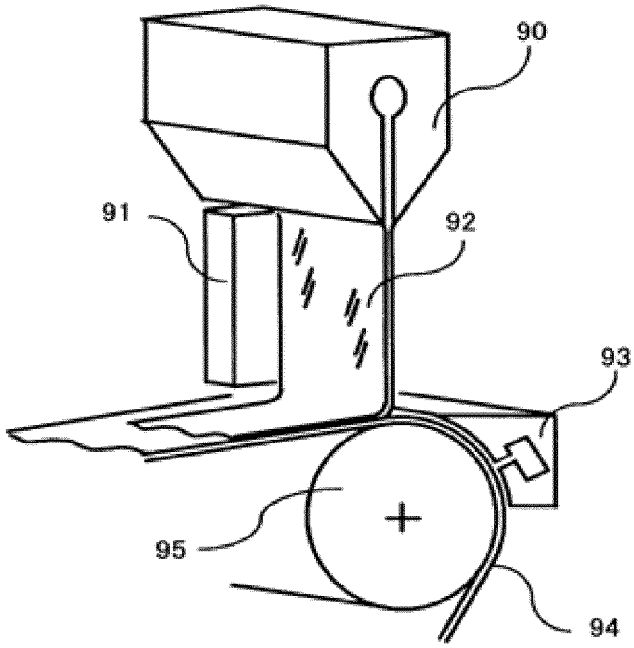
FIG. 1A is a schematic structural diagram of an example of a conventional curtain coating apparatus.

DETAILED DESCRIPTION OF THE INVENTION (Curtain Coating Method and Curtain Coating Apparatus)

A curtain coating method of the present invention including ejecting at least one layer of a coating liquid from a slit; and making the ejected coating liquid fall freely from a curtain nozzle lip by using a curtain edge guide which guides the coating liquid in the form of a curtain liquid film, so as to apply the coating liquid onto a continuously running web. For example, the curtain coating method includes an ejection step, and may include a conveying step, and if necessary further includes other steps.

A curtain coating apparatus of the present invention includes a slit from which at least one layer of a coating liquid is ejected; a slide surface on which the ejected coating liquid is introduced; a curtain nozzle lip provided on the slide surface; a curtain edge guide configured to guide the introduced coating liquid in the form of a curtain liquid film and make the coating liquid fall freely from a curtain nozzle lip, so as to apply the coating liquid onto a continuously running web. For example, the curtain coating apparatus includes an ejection unit, and may include a conveying unit, and if necessary further includes other units.

In the present invention, coating is performed by moving the curtain edge guide toward the depth direction, i.e., a direction perpendicular to the direction where the coating liquid falls down, when a curtain film (also referred to as curtain liquid film) is seen from the front.

The moving distance of the curtain edge guide toward the depth direction, when the curtain film is seen from the front, is preferably 3 mm or more, more preferably 5 mm or more, still more preferably 5 mm to 30 mm, and particularly preferably 5 mm to 15 mm.

On the basis of a position where the top convex of the curtain edge guide is aligned with the vertical line from the lip edge of the curtain nozzle, the distance from the position toward the depth direction when the curtain film is seen from the front is defined. The top convex of the curtain edge guide means the position in the pipe-shaped porous material which is closest to the coating liquid.

The moving distance toward the depth direction is less than 3 mm, the curtain film may not be formed. Because of the structure of the curtain coating apparatus, the maximum moving distance toward the depth direction is 30 mm, and the moving distance cannot exceed 30 mm.

<Ejection Unit and Ejection Step>

The ejection unit is a unit having a coating liquid ejection port, configured to eject a coating liquid from the coating liquid ejection port, and the ejection step is a step of ejecting the coating liquid from a slit.

—Coating Liquid—

The coating liquid is not particularly limited and may be appropriately selected depending on the intended purpose. Examples thereof include acrylic emulsions, heat-sensitive liquids, coating liquids for thermal transfer ribbon, aqueous coating liquids and solvent coating liquids.

An appropriate range of the viscosity of the coating liquid depends on the types of the curtain coating apparatuses including a slot die curtain coating apparatus or a slide die curtain coating apparatus.

The appropriate viscosity range is not particularly limited and may be appropriately selected depending on the intended purpose. In the case of the slot die curtain coating apparatus, the coating liquid preferably has a viscosity at 25° C. of 1 mPa·s to 10,000 mPa·s. In the case of the slide die curtain coating apparatus, the coating liquid preferably has a viscosity at 25° C. of 1 mPa·s to 5,000 mPa·s.

The viscosity may be measured using a B-type viscometer, or the like.

The surface tension of the coating liquid is not particularly limited and may be appropriately selected depending on the intended purpose. It is preferably 20 mN/m to 40 mN/m.

When the surface tension is less than 20 mN/m, the surface tension of the film itself is low, so that the film is slack and thus the film easily deforms and swings by the influence of wind-based disturbance. When the surface tension is greater than 40 mN/m, the curtain film easily deforms in an upward direction.

The surface tension can be measured as a static surface tension in a platinum plate method, using a FACE automatic surface tensiometer (manufactured by Kyowa Interface Science Co., Ltd.) or the like, for example. Moreover, as described in "A study of the behavior of a thin sheet of moving liquid J. Fluid Mechanics, 10:297-305", the dynamic surface tension of the curtain film can be measured by means of the split angle of the film obtained by inserting needle-like foreign matter into the curtain film.

—Coating Liquid Slit—

The coating liquid slit is rectangular in cross-sectional shape.

The size of the coating liquid ejection port is not particularly limited and may be appropriately selected depending on the intended purpose. The slit preferably has a gap of 0.2 mm to 0.5 mm.

The material for the coating liquid ejection port is not particularly limited and may be appropriately selected depending on the intended purpose. The coating liquid ejection port preferably has a metal surface such as of SUS, aluminum or plating such as hard chromium plating.

The material is preferably a metal from the standpoint of improvement in processing accuracy, even if the coating liquid contains resin.

—Ejection Mechanism—

An ejection mechanism for ejecting the coating liquid may be a slot die curtain coating apparatus or a slide die curtain coating apparatus, and the ejection mechanism is appropriately selected from these depending on the intended use.

The slot die curtain coating apparatus is used to apply one or two layers of coating liquid(s). The slot die curtain coating apparatus has a slit which faces downward, so that when the viscosity of the coating liquid is low, liquid dripping may arise and air bubbles in the liquid may remain in a manifold of a die head. However, the slot die curtain coating apparatus is higher in the ejection velocity of the coating liquid than the slide die curtain coating apparatus; therefore, in view of the mechanism in which the curtain film deforms in an upward direction when there is great dynamic surface tension, which is related to the balance between the dynamic surface tension of the coating liquid and the dynamic pressure (inertial force) at the time of the fall of the coating liquid, the coating liquid used with the slot die curtain coating apparatus does not easily deform in an upward direction. Moreover, since a releasing space such as a slide flow-down surface is not provided, washing can be facilitated and the amount of washing liquid used for the washing, such as water, is small. In case the viscosity of the coating liquid is high, coating can be temporarily ceased with ease during an operation.

The slide die curtain coating apparatus is used to apply one or more layers, possibly three or more layers, of coating liquid(s). Since the slide die curtain coating apparatus has a slit which faces upward, bubbles do not easily accumulate in a manifold of a die head. However, the area of a slide portion is large, washing is not easy, and a large amount of washing liquid is required at the time of a cessation of coating during an operation in comparison with the slot die curtain coating apparatus.

—Flow Rate of Coating Liquid—

The flow rate of the coating liquid ejected is not particularly limited and may be appropriately selected depending on the intended purpose, as long as the curtain film can be formed.

The slot die curtain coating apparatus is not particularly limited and may be appropriately selected depending on the intended purpose, as long as the coating liquid is ejected at an intended flow rate and the apparatus has portions in the forms of the slit and the manifold that are capable of forming the curtain film.

The slide die curtain coating apparatus is not particularly limited and may be appropriately selected depending on the intended purpose, as long as it has portions in the forms of the slit and the manifold that enable the coating liquid to be ejected at an intended flow rate, and after the coating liquid is ejected from the slit and then flows down a slide surface, the curtain film can be formed.

<Curtain Edge Guide>

The curtain edge guide is a unit configured to guide the ejected coating liquid in the form of a curtain liquid film, and the curtain edge guide having a pipe-shaped porous material is used.

The pipe-shaped porous material is a porous material in the shape of a pipe whose end face located close to a web, i.e., a lower end face in the height direction of the pipe-shaped porous material, is sealed with a plug, and allows an auxiliary liquid to ooze out from the inside thereof.

The material of the pipe-shaped porous material is not particularly limited and may be appropriately selected depending on the intended purpose, as long as the material is not damaged from the auxiliary liquid contained therein. For example, ceramics, metals, plastics, glass, etc. are preferably used.

The auxiliary liquid is not particularly limited and may be appropriately selected depending on the intended purpose. Examples thereof include water, solutions prepared by mixing water with surfactants, and a main solvent of the coating liquid.

It is preferred to use the auxiliary liquid having lower viscosity than that of the coating liquid in terms of the effect of oozing out the auxiliary liquid from the inside of the pipe-shaped porous material.

<Conveying Unit and Conveying Step>

The conveying unit is a unit configured to convey the support and the conveying step is a step of conveying a support using the conveying unit.

—Support—

The support is not particularly limited and may be appropriately selected depending on the intended purpose, as long as it can support the coating liquid.

The shape, structure and size of the support are not particularly limited and may be appropriately selected depending on the intended purpose.

Examples of the support include release paper, base paper, synthetic paper and polyethylene terephthalate PET film.

The curtain coating apparatus and the curtain coating method of the present invention will be specifically described below with reference to the drawings.

Figure 2:
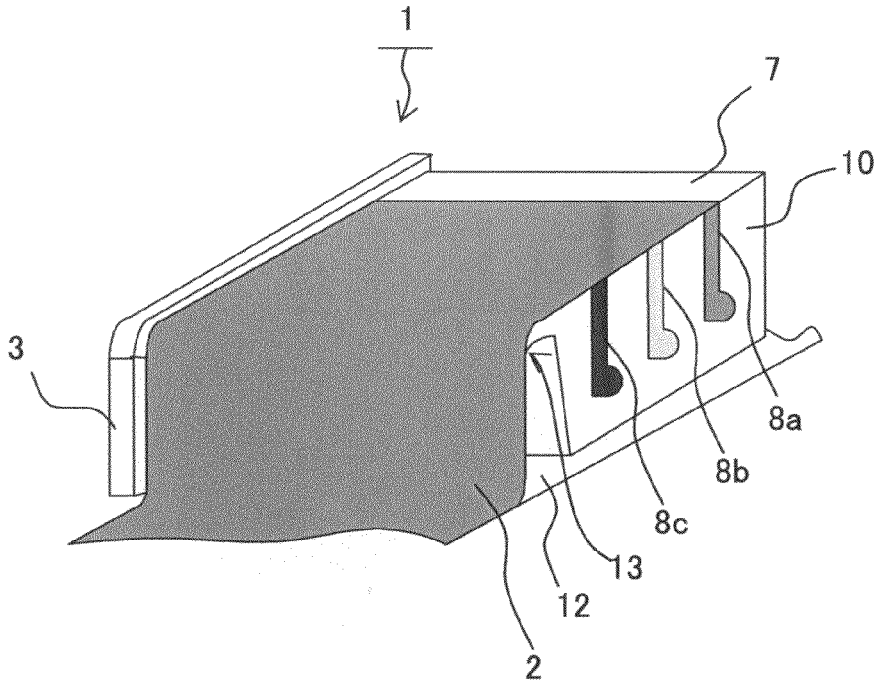
FIG. 2 is a structural diagram of an example of a main part of a curtain coating apparatus of the present invention.
Figure 3:
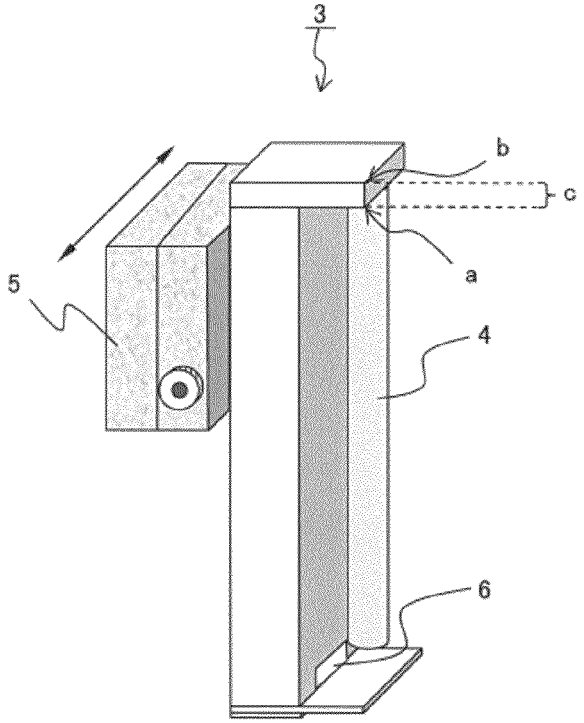
FIG. 3 is a schematic structural diagram of a curtain edge guide.
Figure 4:
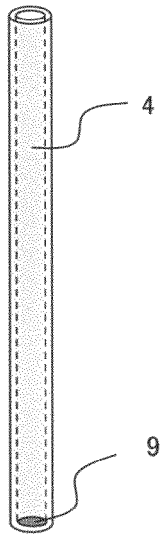
FIG. 4 is a schematic structural diagram of a pipe-shaped porous material of the curtain edge guide.

FIG. 2 is a structural diagram of a main part of a curtain coating apparatus of the present invention, FIG. 3 is a schematic structural diagram of a curtain edge guide, and FIG. 4 is a schematic structural diagram of a pipe-shaped porous material of the curtain edge guide.

A curtain coating apparatus 1 of the present embodiment includes slits 8*a* to 8*c* from which at least one layer (one layer or multi layer) of a coating liquid is ejected; a pair of curtain edge guides 3 configured to guide the ejected coating liquid in the form of a curtain liquid film, and used to make the coating liquid fall freely from an edge of a curtain nozzle lip 13, so as to apply the coating liquid onto a continuously running web 12. The curtain edge guide 3 can be moved toward the depth direction (a direction perpendicular to the direction where the coating liquid falls down) when the curtain film 2 is seen from the front by means of the moving unit 5. The curtain coating is performed, while the curtain edge guide 3 is moved back and forth so as to adjust the curtain edge guide 3 to a desired position depending on the flow rate and the physical properties of the coating liquid.

As shown in FIG. 2, the curtain coating apparatus 1 includes the slits 8*a* to 8*c* of the curtain nozzles of the curtain coating head 10, from the slits 8*a* to 8*c* (the slit 8*a* is used in FIG. 2) a coating liquid is ejected, and the curtain edge guide 3, which is placed so as to guide the coating liquid (the curtain film 2) flowing down on a slide surface 7 in the form of a curtain liquid film, and to make the coating liquid fall down from a curtain nozzle lip 13 provided on the slide surface, and which can be moved toward the depth direction, i.e., a direction perpendicular to the direction where the coating liquid falls down, when the curtain film 2 is seen from the front. Using the curtain coating apparatus 1, the coating liquid can be surely guided to the curtain edge guide, even though the coating liquid does no fall vertically from the lip edge (curtain nozzle lip 13), but flows down with shifting toward depth direction when the curtain film is seen from the front due to the teapot phenomenon.

Figure 1B:
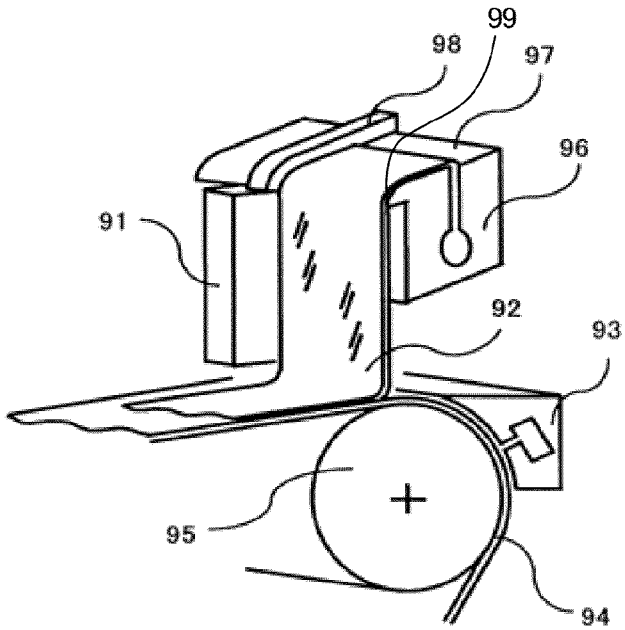
FIG. 1B is a schematic structural diagram of an example of another conventional curtain coating apparatus.

The other units, such as a suction device, a back-up roll, etc., constituting the curtain coating apparatus 1, are not particularly limited and may be known or new units. Thus, specific description and figures thereof are omitted (for example, see FIGS. 1A and 1B).

The pipe-shaped porous material 4 provided in the curtain edge guide 3 as shown in FIG. 3 is a porous material in the shape of a pipe whose end face located close to a web, i.e., a lower end face in the height direction of the pipe-shaped porous material, is sealed with a plug 9, and allows an auxiliary liquid to ooze out from the inside thereof, as shown in FIG. 4. The auxiliary liquid is recovered from an auxiliary liquid vacuum opening 6.

Thus, by providing the curtain edge guide with the pipe-shaped porous material, the curtain edge guide can have a curved surface, which is brought into contact with the curtain film. Moreover, the coating liquid can flow down without deformation by means of the pipe-shaped porous material, owing to a so-called alignment effect. The alignment effect is obtained, because a pair of the curtain edge guides 3 is placed with facing each other in the width direction of the curtain film 2, and owing to the influence of the surface tension of the coating liquid in the form of the curtain liquid film 2, a tensile force between the curtain edge guides 3, which force pulls the curtain liquid film 2 in the width direction so that the curtain edge guides 3 maintain the curtain liquid film 2, is tried to be balanced with a shrink force in the width direction of the coating liquid in the form of the curtain liquid film 2, at the shortest distance, to thereby maintain the curtain film 2 by means of the top convexes of the pipe-shaped porous materials at the shortest distance between the pair of the curtain edge guides 3 in the width direction of the curtain film 2.

Since the pipe-shaped porous material 4 allows the auxiliary liquid to ooze out from the inside thereof, the auxiliary liquid is oozed out from the entire surface of the pipe-shaped porous material 4. Generally, the flow velocity of the curtain film liquid near the curtain edge guide 3 is much slower than the flow velocity of the curtain film liquid in the middle part of the width direction. Strictly, the flow velocity of the curtain film liquid on the curtain edge guide is substantially "0". By oozing out the auxiliary liquid from the inside of the pipe-shaped porous material 4, the flow velocity is increased so as to prevent the phenomenon of curtain film deformation in an upward direction, which is caused by the flow velocity distribution in the width direction of the curtain film. Moreover, in the case of continuous application of the coating liquid for a long period of time, by oozing out the auxiliary liquid from the inside of the pipe-shaped porous material 4, it is possible to prevent adhesion of a liquid residue caused by drying and solidifying the coating liquid on the pipe-shaped porous material of the curtain edge guide.

The material of the pipe-shaped porous material 4 is not particularly limited and may be appropriately selected depending on the intended purpose. For example, ceramics, metals, plastics, glass, etc. are preferably used in terms of excellent processability. It is preferable to select the material which is not damaged from the coating liquid and the auxiliary liquid of the curtain edge guide.

<Distance between Position of Upper End of Pipe-Shaped Porous Material in Height Direction and Curtain Nozzle Lip>

In the curtain edge guide 3 shown in FIG. 3, c in FIG. 3 denotes a distance between a position of an upper end of the pipe-shaped porous material in the height direction (also referred to as a point where the auxiliary liquid makes the pipe-shaped porous material wet in the height direction of the curtain edge guide 3) (a in FIG. 3) and a position corresponding to that of the curtain nozzle lip (b in FIG. 3), and the distance is preferably 1 mm to 7 mm, more preferably 1 mm to 5 mm. As a result, the curtain film can be formed on the pipe-shaped porous material of the curtain edge guide without deformation.

When the distance between the position of the upper end of the pipe-shaped porous material in the height direction and the curtain nozzle lip is less than 1 mm, the rigidity of the part for maintaining the pipe-shaped porous material 4 is insufficient in terms of the structure of the curtain edge guide, and it may become difficult to maintain the curtain edge guide. When the distance between the position of the upper end of the pipe-shaped porous material in the height direction and the curtain nozzle lip is more than 7 mm, deformation of the curtain film caused by the teapot phenomenon cannot be corrected on the curtain edge guide 3, and it may become difficult to prevent occurrence of deformation.

<Pipe-Shaped Porous Material>

The diameter of the pipe-shaped porous material 4 on the curtain edge guide is preferably 5 mm to 10 mm. The diameter of the pipe-shaped porous material 4 in the above range allows the coating liquid to flow down while deformation of the curtain film due to the teapot phenomenon is not occurred on the curtain edge guide.

When the diameter of the pipe-shaped porous material 4 is smaller than 5 mm, the pipe-shaped porous material 4 has low rigidity, causing difficulty in production of the curtain coating apparatus. When the diameter of the pipe-shaped porous material 4 is larger than 10 mm, the curvature of the pipe-shaped porous material of the curtain edge guide increases, and the aforementioned alignment effect may not be obtained.

<Moving Unit>

The moving unit configured to move the curtain edge guide 3 toward the depth direction when the curtain film is seen from the front is not particularly limited and may be appropriately selected depending on the intended purpose, as long as the moving unit can move the curtain edge guide 3 back and forth toward the depth direction when the curtain film is seen from the front. For example, as shown in FIG. 3 a moving stage 5 is preferably used as the moving unit. The curtain edge guide 3 fixed on the moving stage 5 is moved back and forth, as the moving stage 5 moves back and forth in an arrow direction shown in FIG. 3 by means of an unillustrated driving unit.

In this way, the curtain edge guide 3 can be positioned by an easy method. The moving stage 5 is not particularly limited and may be appropriately selected depending on the intended purpose. For example, a stage for an optical experiment is preferably used. Thus, the curtain edge guide 3 can be positioned with high accuracy.

<Driving Unit>

The driving unit for moving and positioning the moving unit (moving stage 5) is not particularly limited and may be appropriately selected depending on the intended purpose. For example, a motor (driving motor) is preferably used. By controlling the motor using the unillustrated control unit, the moving unit can be moved and positioned at a position away from the curtain film. As a result, it is possible to prevent occurrence of troubles, for example, an operator etc. beaks the curtain film by mistake.

The aforementioned embodiment is an exemplary preferred embodiment of the present invention, and the invention is not limited thereto. Various changes and modifications may be made without departing the gist of the present invention

EXAMPLES

Hereinafter, the present invention will be specifically described with Examples and Comparative Examples, but these should not be construed as limiting to the scope of the present invention in any way. In the following examples, "part(s)" and "%" respectively means "part(s) by mass" and "% by mass".

Example 1

—Preparation of Thermosensitive Recording Layer Coating Liquid—

A thermosensitive recording layer coating liquid was prepared using the following compositions in the usual manner.

| | |
|---|---|
| 3-dibutylamino-6-methyl-7-anilinofluoran | 4 parts |
| 4-isopropoxy-4'-hydroxydiphenylsulfone | 12 parts |
| Silica | 6 parts |
| 10% polyvinyl alcohol aqueous solution | 16 parts |
| Water | 41 parts |

The resultant thermosensitive recording layer coating liquid had a viscosity of 150 mPa·s at 25° C., and a static surface tension of 38 mN/m. The viscosity was measured using a B-type viscometer (manufactured by TOKYO KEIKI INC., MODEL BL No. 2 rotor, 60 rpm). The static surface tension was measured using FACE automatic surface tensiometer CBVP-A3 type (manufactured by Kyowa Interface Science Co., Ltd.).

A curtain film was formed in such a manner that the prepared thermosensitive recording layer coating liquid flowed down using the curtain coating apparatus shown in FIGS. 2 and 3 under the conditions that an ejection width was 250 mm and that a flow rate of the coating liquid ejected from a nozzle slit was 2,400 g/min.

The other conditions for forming the curtain film were as follows: the height of a curtain edge guide was 150 mm, the amount of an auxiliary liquid (water) was 50 cc/min, the distance between the position of the upper end of the pipe-shaped porous material in the height direction and the curtain nozzle lip was 5 mm, the diameter of a pipe-shaped porous material was 6 mm, and a lower end of the pipe-shaped porous material in the vertical direction was sealed with a plug. As the pipe-shaped porous material, a ceramic material was used.

<Evaluation Method>

(1) Whether or not the curtain film was guided to the curtain edge guide was visually observed based on the following evaluation criteria.

The results are shown in Table 1.

Evaluation Criteria

A: A curtain film was suitably formed.

B: A curtain film was formed.

C: No curtain film was formed.

(2) The presence or absence of the deformation of the curtain film on the pipe-shaped porous material of the curtain edge guide was visually observed, and evaluated based on the following evaluation criteria. The results are shown in Table 1.

Evaluation Criteria

A: The curtain film was not deformed.

B: The curtain film was slightly deformed, but there was no problem in practical use.

C: No curtain film was formed.

<Evaluation Results>

In Example 1, the teapot phenomenon was occurred in such a state that a curtain film was shifted by 5 mm toward the depth direction from the vertical line from a lip edge of the curtain nozzle when the curtain film was seen from the front.

Then, when the top convex of the curtain edge guide was aligned with the vertical line from the lip edge of the curtain nozzle, the curtain film was not guided to the curtain edge guide. However, using the moving stage the curtain film was suitably formed by moving the curtain edge guide by 5 mm toward the depth direction from a position where the top convex of the curtain edge guide was aligned with the vertical line from the lip edge of the curtain nozzle, when the curtain film was seen from the front. Moreover, the curtain film was not deformed on the pipe-shaped porous material of the curtain edge guide.

Example 2

A curtain film was formed in the same manner as in Example 1, except that using the moving stage the curtain edge guide was moved by 3 mm toward the depth direction when the curtain film was seen from the front.

When the top convex of the curtain edge guide was brought into contact with the vertical line from the lip edge of the curtain nozzle, the curtain film was not guided to the curtain edge guide. However, using the moving stage the curtain film could be formed by moving the curtain edge guide by 3 mm toward the depth direction when the curtain film was seen from the front. Moreover, the curtain film was slightly deformed on the pipe-shaped porous material of the curtain edge guide.

Example 3

A curtain film was formed in the same manner as in Example 1, except that the distance between the position of the upper end of the pipe-shaped porous material in the height direction and the curtain nozzle lip was 1 mm.

When the top convex of the curtain edge guide was brought into contact with the vertical line from the lip edge of the curtain nozzle, the curtain film was not guided to the curtain edge guide. However, using the moving stage the curtain film could be formed by moving the curtain edge guide by 5 mm toward the depth direction when the curtain film was seen from the front. Moreover, the curtain film was slightly deformed on the pipe-shaped porous material of the curtain edge guide.

Example 4

A curtain film was formed in the same manner as in Example 1, except that the distance between the position of the upper end of the pipe-shaped porous material in the height direction and the curtain nozzle lip was 3 mm.

When the top convex of the curtain edge guide was brought into contact with the vertical line from the lip edge of the curtain nozzle, the curtain film was not guided to the curtain edge guide. However, using the moving stage the curtain film could be formed by moving the curtain edge guide by 5 mm toward the depth direction when the curtain film was seen from the front. Moreover, the curtain film was not deformed on the pipe-shaped porous material of the curtain edge guide.

Example 5

A curtain film was formed in the same manner as in Example 1, except that the distance between the position of the upper end of the pipe-shaped porous material in the height direction and the curtain nozzle lip was 7 mm.

When the top convex of the curtain edge guide was brought into contact with the vertical line from the lip edge of the curtain nozzle, the curtain film was not guided to the curtain edge guide. However, using the moving stage the curtain film could be formed by moving the curtain edge guide by 5 mm toward the depth direction when the curtain film was seen from the front. Moreover, the curtain film was not deformed on the pipe-shaped porous material of the curtain edge guide.

Example 6

A curtain film was formed in the same manner as in Example 1, except that the distance between the position of the upper end of the pipe-shaped porous material in the height direction and the curtain nozzle lip was 10 mm.

When the top convex of the curtain edge guide was brought into contact with the vertical line from the lip edge of the curtain nozzle, the curtain film was not guided to the curtain edge guide. However, using the moving stage the curtain film could be formed by moving the curtain edge guide by 5 mm toward the depth direction when the curtain film was seen from the front. Moreover, the curtain film was slightly deformed on the pipe-shaped porous material of the curtain edge guide.

Example 7

A curtain film was formed in the same manner as in Example 1, except that the diameter of the pipe-shaped porous material in the curtain edge guide was 5 mm.

When the top convex of the curtain edge guide was brought into contact with the vertical line from the lip edge of the curtain nozzle, the curtain film was not guided to the curtain edge guide. However, using the moving stage the curtain film could be formed by moving the curtain edge guide by 5 mm toward the depth direction when the curtain film was seen from the front. Moreover, the curtain film was slightly deformed on the pipe-shaped porous material of the curtain edge guide.

Example 8

A curtain film was formed in the same manner as in Example 1, except that the diameter of the pipe-shaped porous material in the curtain edge guide was 10 mm.

When the top convex of the curtain edge guide was brought into contact with the vertical line from the lip edge of the curtain nozzle, the curtain film was not guided to the curtain edge guide. However, using the moving stage the curtain film could be formed by moving the curtain edge guide by 5 mm toward the depth direction when the curtain film was seen from the front. Moreover, the curtain film was not deformed on the pipe-shaped porous material of the curtain edge guide.

Example 9

A curtain film was formed in the same manner as in Example 1, except that the diameter of the pipe-shaped porous material in the curtain edge guide was 11 mm.

When the top convex of the curtain edge guide was brought into contact with the vertical line from the lip edge of the curtain nozzle, the curtain film was not guided to the curtain edge guide. However, using the moving stage the curtain film could be formed by moving the curtain edge guide by 5 mm toward the depth direction when the curtain film was seen from the front. Moreover, the curtain film was slightly deformed on the pipe-shaped porous material of the curtain edge guide.

Comparative Example 1

A curtain film was formed in the same manner as in Example 1, except that the curtain edge guide was not moved toward the depth direction when the curtain film was seen from the front using the moving stage.

No curtain film was formed, because the curtain edge guide was not moved toward the depth direction when the curtain film was seen from the front.

Comparative Example 2

Figure 5:
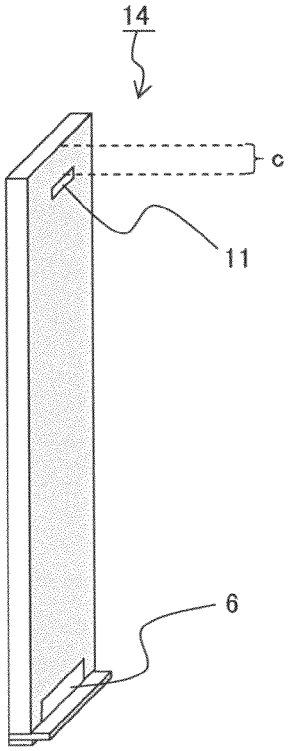
FIG. 5 is a schematic structural diagram of a curtain edge guide used in Comparative Example 2.

A curtain film was formed in the same manner as in Example 1, except that as the curtain edge guide a flat plate-shaped curtain edge guide 14 shown in FIG. 5 was used instead of the pipe-shaped porous material. The reference sign 11 in FIG. 5 denotes an ejection port of the auxiliary liquid.

No problem occurred in formation of the curtain film. However, an alignment effect on the curtain edge guide could not be obtained, and the curtain film was deformed. Moreover, the curtain film was not located on the surface where the auxiliary liquid flowed down, and the curtain film was unstably formed.

Next, the evaluation results of Examples 1 to 9 and Comparative Examples 1 to 2 are shown in Table 1.

TABLE 1

| | Moving distance toward the depth direction of the curtain edge guide | Whether or not the curtain film was guided to the curtain edge guide | Deformation of the curtain film on pipe-shaped porous material of the curtain edge guide |
|---|---|---|---|
| Ex. 1 | 5 mm | A | A |
| Ex. 2 | 3 mm | A | B |
| Ex. 3 | 5 mm | B | B |
| Ex. 4 | 5 mm | A | A |
| Ex. 5 | 5 mm | A | A |
| Ex. 6 | 5 mm | A | B |
| Ex. 7 | 5 mm | B | B |
| Ex. 8 | 5 mm | A | A |
| Ex. 9 | 5 mm | A | A |
| Comp. Ex. 1 | 0 mm | C | C |
| Comp. Ex. 2 | — | A | C |

This application claims priority to Japanese patent application No. 2010-225828, filed on Oct. 5, 2010, and incorporated herein by reference.

What is claimed is:

1. A curtain coating method comprising:

ejecting at least one layer of a coating liquid from a slit; and making the ejected coating liquid fall freely from a curtain nozzle lip by using a curtain edge guide which guides the coating liquid in the form of a curtain liquid film, so as to apply the coating liquid onto a continuously running web, wherein the coating liquid is applied by moving the curtain edge guide toward the depth direction when the curtain liquid film is seen from the front.

2. The curtain coating method according to claim 1, wherein a distance of moving the curtain edge guide toward the depth direction when the curtain film is seen from the front is 3 mm or more.

3. The curtain coating method according to claim 1, wherein the curtain edge guide is provided with a pipe-shaped porous material whose end face located close to a web is sealed, and the coating liquid is applied while an auxiliary liquid oozes out from an inside of the pipe-shaped porous material.

4. The curtain coating method according to claim 3, wherein a distance between an upper end of the pipe-shaped porous material in a height direction and the curtain nozzle lip is 1 mm to 7 mm.

5. The curtain coating method according to claim 3, wherein the pipe-shaped porous material has a diameter of 5 mm to 10 mm.

6. The curtain coating method according to claim 1, wherein the curtain edge guide is moved by a moving unit, and as the moving unit a moving stage is used.

7. The curtain coating method according to claim 6, wherein the moving unit is driven by a driving unit, and as the driving unit a motor is used.

8. A curtain coating apparatus comprising:

a slit from which at least one layer of a coating liquid is ejected;

a slide surface on which the ejected coating liquid is introduced;

a curtain nozzle lip provided on the slide surface;

a curtain edge guide configured to guide the introduced coating liquid in the form of a curtain liquid film and make the coating liquid fall freely from the curtain nozzle lip, so as to apply the coating liquid onto a continuously running web, and a moving unit configured to move the curtain edge guide toward the depth direction when the curtain film is seen from the front.

9. The curtain coating apparatus according to claim 8, wherein a distance of moving the curtain edge guide toward the depth direction when the curtain film is seen from the front is 3 mm or more.

10. The curtain coating apparatus according to claim 8, wherein the curtain edge guide is provided with a pipe-shaped porous material whose end face located close to a web is sealed, and an auxiliary liquid oozes out from an inside of the pipe-shaped porous material.

11. The curtain coating apparatus according to claim 10, wherein a distance between an upper end of the pipe-shaped porous material in a height direction and the curtain nozzle lip is 1 mm to 7 mm.

12. The curtain coating apparatus according to claim 10, wherein the pipe-shaped porous material has a diameter of 5 mm to 10 mm.

13. The curtain coating apparatus according to claim 8, wherein the moving unit is a moving stage.

14. The curtain coating apparatus according to claim 13, further includes a driving unit configured to drive the moving unit, wherein the diving unit is a motor.

* * * * *